US010556265B2

(12) United States Patent
Furuse et al.

(10) Patent No.: US 10,556,265 B2
(45) Date of Patent: Feb. 11, 2020

(54) COILING MACHINE AND MANUFACTURING METHOD OF COIL SPRING

(71) Applicant: NHK SPRING CO., LTD., Yokohama-shi, Kanagawa (JP)

(72) Inventors: Takeshi Furuse, Yokohama (JP); Yusuke Kumagawa, Yokohama (JP)

(73) Assignee: NHK SPRING CO., LTD., Yokohama-Shi, Kanagawa (JP)

( * ) Notice: Subject to any disclaimer, the term of this patent is extended or adjusted under 35 U.S.C. 154(b) by 158 days.

(21) Appl. No.: 15/686,849

(22) Filed: Aug. 25, 2017

(65) Prior Publication Data

US 2017/0348759 A1 Dec. 7, 2017

Related U.S. Application Data

(63) Continuation of application No. PCT/JP2016/053404, filed on Feb. 4, 2016.

(30) Foreign Application Priority Data

Feb. 26, 2015 (JP) ..... 2015-036456

(51) Int. Cl.
*B21F 3/06* (2006.01)
*B21F 35/00* (2006.01)
*B21F 11/00* (2006.01)

(52) U.S. Cl.
CPC ..... *B21F 3/06* (2013.01); *B21F 35/00* (2013.01); *B21F 11/005* (2013.01)

(58) Field of Classification Search
CPC ..... B21F 3/00; B21F 3/02; B21F 3/04; B21F 3/06; B21F 11/005; B21F 23/00; B21F 35/00; B21F 11/00; B21F 35/02
See application file for complete search history.

(56) References Cited

U.S. PATENT DOCUMENTS 5,761,943 A * 6/1998 Blasius ..... B21C 51/00 72/132
2006/0230803 A1* 10/2006 Ruzovic ..... B21C 51/00 72/138

(Continued)

FOREIGN PATENT DOCUMENTS

JP 58-192643 A * 11/1983 ..... B21F 35/00
JP 58-202935 A * 11/1983 ..... B21F 3/02

(Continued)

OTHER PUBLICATIONS

Translation, KR1014196987 B1, Jul. 2014.*

(Continued)

*Primary Examiner* — Edward T Tolan
(74) *Attorney, Agent, or Firm* — Holtz, Holtz & Volek PC

(57) ABSTRACT

A coiling machine includes a material guide, first pin, second pin, pitch tool, cutting tool, heating device, temperature sensor, and controller. A material is bent between the first pin and the second pin to form an arc part between the first pin and the second pin. The controller select control data corresponding to the temperature of the material from a plurality of control data corresponding to a processing temperature. Then, the positions of the first pin and the second pin are controlled such that a radius of curvature of the arc part increases when the temperature of the material increases, and the position of the cutting tool is controlled such that a gap between the center of curvature of the arc part and the cutting tool increases.

1 Claim, 6 Drawing Sheets

(56) References Cited

U.S. PATENT DOCUMENTS

| | | | | |
|---|---|---|---|---|
| 2011/0239718 | A1* | 10/2011 | Kalkau | B21C 51/00 72/17.3 |
| 2011/0239719 | A1 | 10/2011 | Kalkau et al. | |
| 2014/0311204 | A1* | 10/2014 | Sigg | B21F 3/02 72/139 |
| 2015/0273565 | A1* | 10/2015 | Jung | B21F 3/02 72/137 |

FOREIGN PATENT DOCUMENTS

| | | | | |
|---|---|---|---|---|
| JP | 63154237 | A | 6/1988 | |
| JP | 02037925 | A | 2/1990 | |
| JP | 09141371 | A | 6/1997 | |
| JP | 11197775 | A | 7/1999 | |
| JP | 2003154410 | A | 5/2003 | |
| JP | 2004306075 | A | 11/2004 | |
| JP | 2013226584 | A | 11/2013 | |
| KR | 101419698 | B1 | 7/2014 | |
| WO | 2014/042066 | A1 * | 3/2014 | B21F 3/02 |

OTHER PUBLICATIONS

International Search Report (ISR) and Written Opinion dated Mar. 15, 2016 issued in International Application No. PCT/JP2016/053404.

"Database WPI" Thomson Scientific, London, GB; AN 2014-P03446, "Device for Manufacturing Hot Coil Spring".

Extended European Search Report (EESR) dated Oct. 29, 2018 issued in European Application No. 16755168.8.

* cited by examiner

COILING MACHINE AND MANUFACTURING METHOD OF COIL SPRING

CROSS-REFERENCE TO RELATED APPLICATIONS

This application is a Continuation Application of PCT Application No. PCT/JP2016/053404, filed Feb. 4, 2016 and based upon and claiming the benefit of priority from prior Japanese Patent Application No. 2015-036456, filed Feb. 26, 2015, the entire contents of all of which are incorporated herein by reference.

BACKGROUND OF THE INVENTION

1. Field of the Invention

The present invention described herein relate generally to a mandrel-less coiling machine configured to manufacture a coil spring through cold working or through warm working, and a manufacturing method of a coil spring.

2. Description of the Related Art

An example of a coiling machine which manufactures a coil spring through cold working is disclosed in JP11-197775A (Patent Literature 1). Patent Literature 1 discloses a coiling machine without a mandrel (mandrel-less coiling machine). The mandrel-less coiling machine bends a material of a coil spring discharged from a tip of a material guide with a certain curvature by a first pin and a second pin and the bent material is pitched by a pitch tool.

Positions of the first pin and the second pin, the pitch tool, and the like are controlled on the basis of computer programs and control data corresponding to shape of the coil spring stored in a controller, for example. That is, the first pin and the second pin are moved to the positions corresponding to a coil radius by a cam and an actuator driven on the basis of the control data corresponding to the shape of the coil spring to be formed. JP 2013-226584A (Patent Literature 2) discloses a coiling machine which controls positions of a first pin and a second pin using a machine center as a reference. Conventional mandrel-less coiling machines as disclosed in Patent Literatures 1 and 2 manufacture a coil spring through cold working (at a normal temperature).

It is known that, depending on the kinds of spring steels, the hardness and the strength of the material are improved when the coil spring is processed in a higher temperature (a warm working range) than the temperature of the cold working process. The warm working process is performed in a temperature lower than a temperature used in a hot working process (a temperature equal to or lower than a recrystallization temperature of the material). For example, if a coil spring with a tempered martensite formed by a heating process is subjected to a warm working process in approximately 300° C., the yield strength is improved by dynamic strain aging in some of the spring steels.

If a coil spring is manufactured through a warm working process, a heating process such as strain relief annealing or an aftertreatment such as hot setting quenching can be performed using a residual heat of the warm working process. Thus, reheating after coiling is not required and the manufacturing process of the coil spring can be simplified. On the other hand, if a coil spring is manufactured through a cold working process, a heating process such as strain relief annealing and hot setting are performed after coiling, and thus, the coil spring must be reheated.

To perform a warm working process of a coil spring, using a conventional mandrel-less coiling machine for cold working process has been considered. However, if a material of a coil spring is heated to a warm working range to perform a warm working process of a coil spring, the shape of the coil spring formed through the warm working process may be significantly shifted from a desired shape depending on the temperature of the material. Furthermore, a position of a cutting tool is shifted from a proper position, an end or the coil spring may not be cut desirably. These points should be improved.

BRIEF SUMMARY OF THE INVENTION

Thus, the purpose of the present invention is to provide a coiling machine which can form a coil spring with a less difference from the desired shape through not only a cold working process but also a warm working process and a manufacturing method of the same.

According to an embodiment, a coiling machine includes a material guide to which a material of a coil spring is inserted, first pin, second pin, pitch tool, heating device configured to heat the material, temperature sensor configured to detect a temperature of the material, and controller. The material discharged from a tip of the material guide contacts the first pin. The second pin is disposed in a front side of a movement direction of the material with respect to the first pin. The material is bent between the first pin and the second pin to form an arc part. The pitch tool is disposed in a front side of the movement direction of the material with respect to the second pin and contacts the material. The controller changes positions of the first pin and the second pin on the basis of control data corresponding to a shape of the coil spring to be formed. Furthermore, the controller is configured to change a position of the first pin and a position of the second pin such that a radius of curvature of the arc part increases when the sensor increases, and to move the cutting tool such that a gap between a center of curvature of the arc part and the cutting tool increases when the temperature of the material increases.

According to the embodiment, a coil spring with a less difference from the desired shape can be manufactured through not only a cold working process but also a warm working process.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OP THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, a coiling machine and a manufacturing method of a coil spring according to an embodiment will be described with reference to FIGS. 1 to 6.

Figure 6:
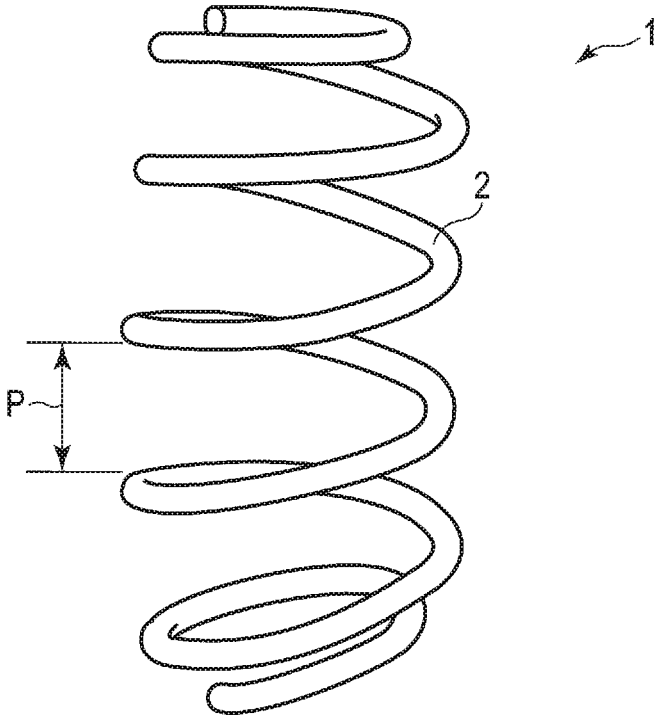
FIG. 6 is a perspective view showing an example of a coil spring.

FIG. 6 shows an example of a coil spring 1. The coil spring 1 is formed as a spiral of a material 2 which is a spring steel wound at a certain pitch P (which may not be constant). The shape of the coil spring 1 may be varied and a coil diameter and a pitch may change therein in some positions of winding. The coil spring may be formed as various shapes such as a barrel coil spring, a hourglass-shaped coil spring, tapered coil spring, uneven pitch coil spring, or partly minus pitched coil spring.

Figure 1:
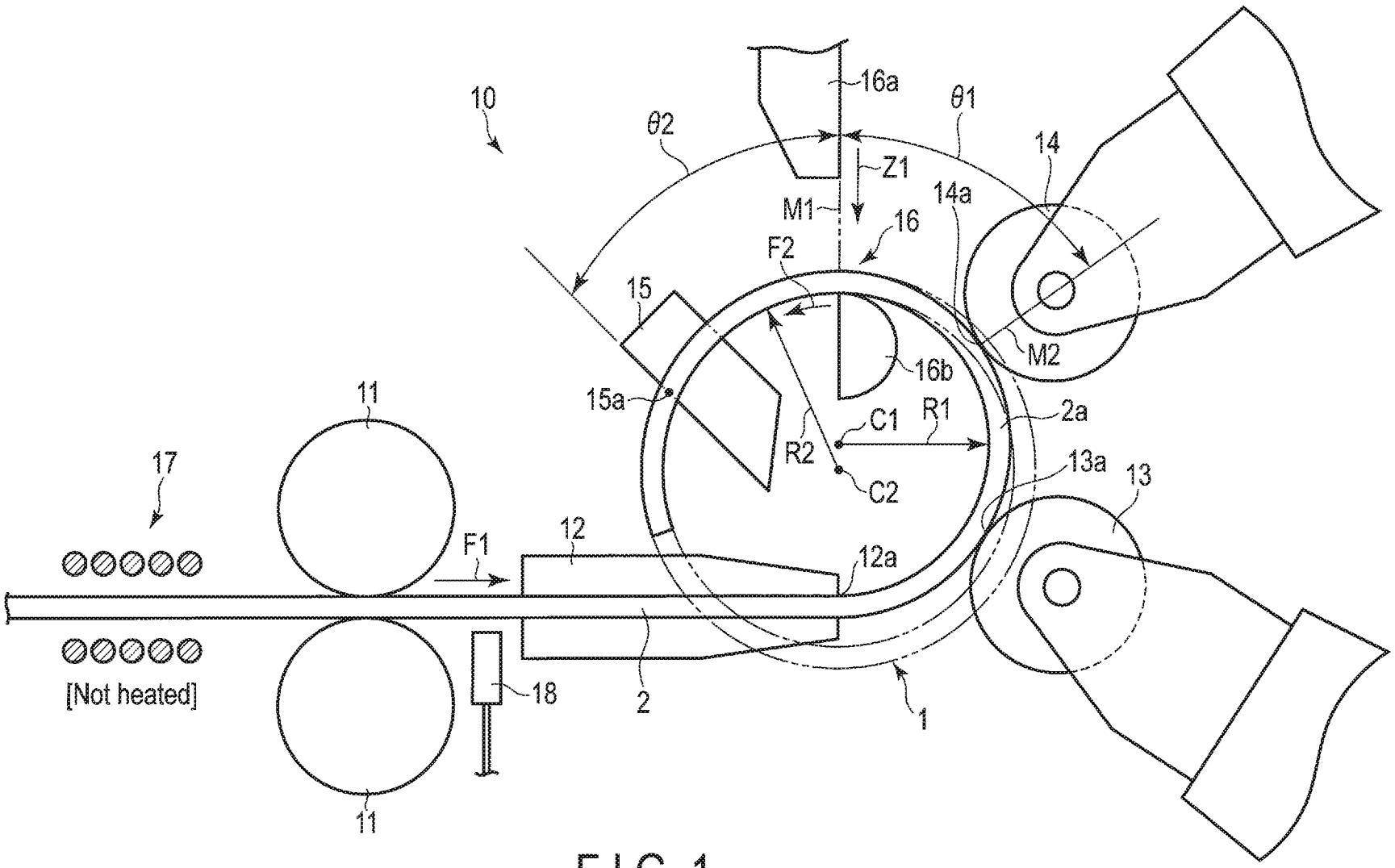
FIG. 1 is a front view showing a cold working process in a part of a coiling machine of an embodiment.
Figure 2:
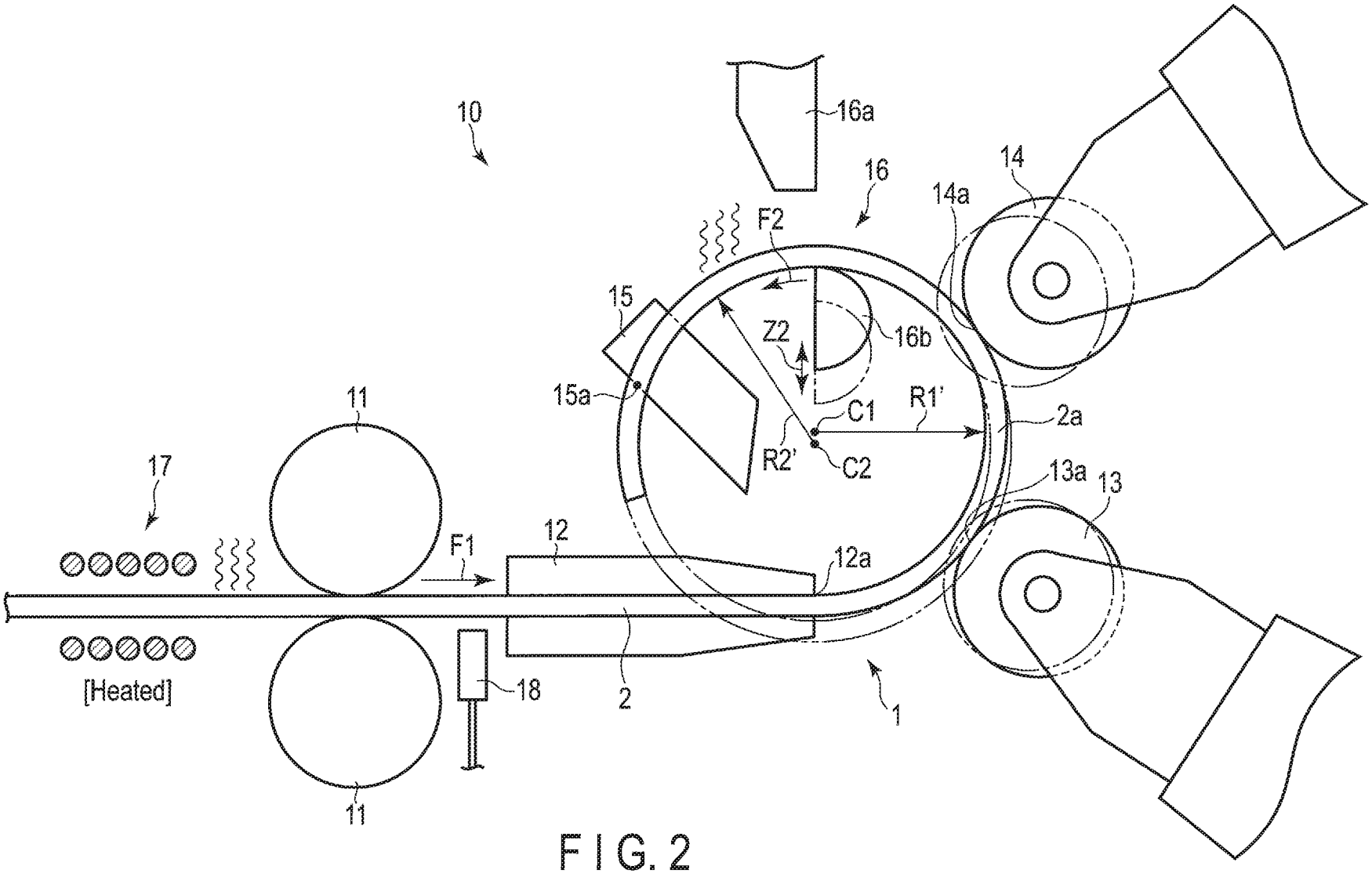
FIG. 2 is a front view showing a warm working process in a part of the coiling machine of FIG. 1.

FIGS. 1 and 2 schematically show a part of the coiling machine 10 of an embodiment. FIG. 1 shows the coil spring 1 in a cold working process. FIG. 2 shows the coil spring 1 in a warm working process.

The coiling machine 10 includes at least a pair of material feeding rollers (feed rollers) 11, material guide 12 to which a material 2 is inserted, first pin 13, second pin 14, pitch tool 15, and cutting tool 16. The material feeding roller 11 moves the material 2 of the coil spring in a direction indicated by arrow F1 in the figures. The material 2 discharged from a tip 12*a* of the material guide 12 initially contacts the first pin 13. The material 2 bend by the first pin 13 contacts the second pin 14. The cutting tool 16 cuts one unit of the formed coil spring.

The first pin 13 is disposed in a front side of a movement direction of the material 2 with respect to the tip 12*a* of the material guide 12 (in a downstream side of the movement direction). The second pin 14 is disposed in a front side of a movement direction of the material 2 with respect to the first pin 13. The material 2 is moved from the tip 12*a* of the material guide 12 to the first pin 13. The material 2 discharged from the tip 12*a* of the material guide 12 is bent in an arc shape between the tip 12*a* and a contact point 13*a* of the first pin 13 with the tip 12*a* of the material guide 12 as a substantial bending point. The material 2 passes de first pin 13 and is further bent in an arc shape while reaching a contact point 14*a* of the second pin 14. Accordingly, an arc part 2*a* is formed continuously of radius of curvature R1 (shown in FIG. 1) or of radius of curvature R1' (shown in FIG. 2) between the first pin 13 and the second pin 14.

The arc part 2*a* is formed between the first pin 13 and the second pin 14. The radius of curvature R1 of the arc part 2*a* during a cold working formation process (FIG. 1) is minimized between the first pin 13 and the second pin 14. After the radius of curvature R1 is minimized, the radius of curvature R1 gradually increases while the arc part 2*a* reaches the second pin 14 from the first pin 13 because of a spring back effect. The radius of curvature R1' of the arc part 2*a* during a warm working formation (FIG. 2) is minimized between the first pin 13 and the second pin 14. After the radius of curvature R1' is minimized, the radius of curvature R1' gradually increases while the arc part 2*a* reaches the second pin 14 from the first pin 13 because of a spring back effect to some extent.

The pitch tool 15 is disposed in a front side of a movement direction of the material 2 with respect to the second pin 14. The pitch tool 15 contacts the material 2 which passed through the second pin 14 from a direction along an axis of the coil spring 1 at a contact point 15*a*. Thus, the coil spring 1 is pitched.

The cutting tool 16 includes a movable blade 16*a* and a receiving blade 16*b*. The rear end of one unit of the formed coil spring 1 (the front end of a next unit of the coil spring) is cut (sheared) between the movable blade 16*a* and the receiving blade 16*b*. The movable blade 16*a* moves in the direction of arrow Z1 (of FIG. 1) to the receiving blade 16*b* while the material feeding roller 11 is stopped. Thereby, the material 2 is cut. The receiving blade 16*b* of the cutting tool 16 can move in the vertical directions (the directions of arrow 12 of FIG. 2) by an actuator. The receiving blade 16*b* moves in the directions of arrow Z2, and a cutting position (cutting height) changes. Note that the cutting position may be changed by moving the movable blade 16*a* and the receiving blade 16*h* in the vertical directions to the same extent in synchronization with each other.

In a suitable example of the cutting tool 16, the cutting tool 16 may be structured to move with the material 2 at the same speed in the movement direction F2 of the material 2 during the cutting process of the material 2. In this structure, the movable blade 16*a* and the receiving blade 16*b* move with the material 2 at the same speed with and in the same movement direction of the material 2 which has passed the second pin 14, and cut the material 2.

A heating device 17 is disposed in the upstream side of the material feeding roller 11 (in the rear side of the movement direction of material) with respect to the movement direction of the material 2 (the directions of arrows F1 of FIGS. 1 and 2). The heating device 17 is, for example, a high frequency heating device. The heating device 17 is turned off when the coil spring 1 is formed through a cold working process, and the material 2 is not heated. On the other hand, the heating device 17 is turned on when the coil spring 1 is formed through a warm working process. With the heating device 17 turned on, the material 2 is heated to a temperature suitable for the warm working process by high frequency guidance heating.

A temperature sensor 18 as temperature detection means is disposed in the downstream side of the material feeding roller 11 (in a front side of a movement direction of the material) with respect to the movement direction of the material 2. The temperature sensor 18 detects a temperature of the material 2 (temperature of the material 2 immediately before becoming the coil spring 1) and outputs a signal related to the detected temperature to CPU 20 which will be described below.

Figure 3:
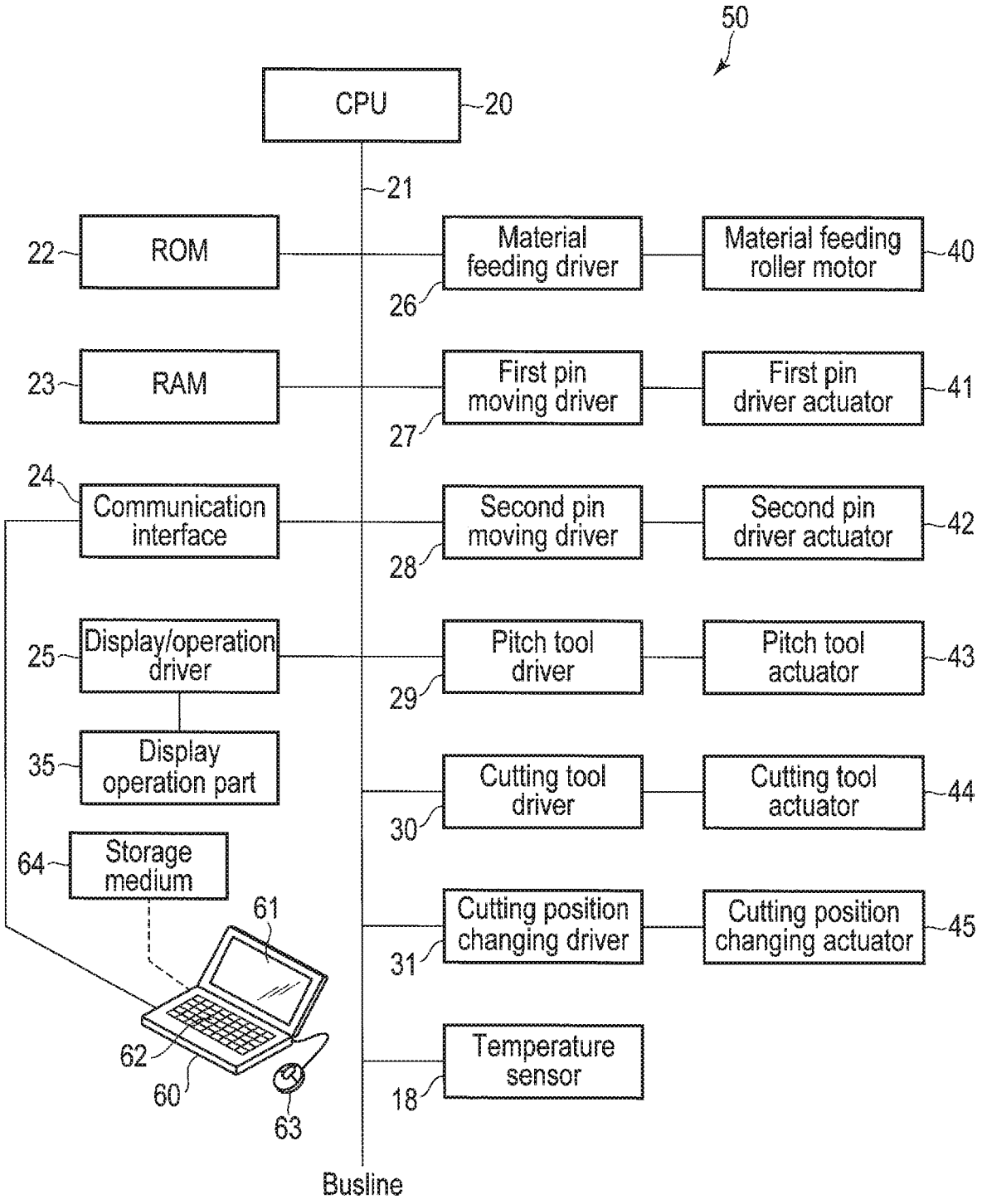
FIG. 3 is a block diagram showing an electrical structure of the coiling machine of FIG. 1.

FIG. 3 is a block diagram showing an electrical structure of the coiling machine 10. The coiling machine 10 includes a central processing unit (CPU) 20 which functions as a controller. To CPU 20, through a bus line 21, a read only memory (ROM), random access memory 23 (RAM), communication interface 24, display/operation driver 25, material feeding driver 26, first pin moving driver 27, second pin moving driver 28, pitch tool driver 29, cutting tool driver 30, cutting position changing driver 31, temperature sensor 18 are connected.

ROM 22 stores program to control CPU 20 and various fixed data. RAM 23 includes various data necessary to form the coil spring. Furthermore, RAM 23 includes various memory areas used to store various data necessary to obtain an estimated shape which will be describes later. The communication interface 24 controls data communication performed with external devices through a communication line (network). The display/operation driver 25 controls a display operation unit 35 including a display (display panel). The display operation part 35 is operated by an operator, and the data necessary to form the coil spring are stored in the memories such as RAM 23.

The material feeding driver 26 controls a motor 40 which rotates the material feeding roller 11. The first pin movement driver 27 controls a first pin driving mechanism 41. The first pin driving mechanism 41 includes an actuator which drives the first pin 13. The second pin movement driver 28 controls a second pin driving mechanism 42. The second pin driving mechanism 42 includes an actuator which drives the second pin 14. The pitch tool driver 29 controls a pitch tool driving mechanism 43. The pitch tool driving mechanism 43 includes an actuator which drives the pitch tool 15. The cutting tool driver 30 controls a cutting tool driving mechanism 44. The cutting tool driving mechanism 44 includes an actuator which drives the cutting tool 16. The cutting position changing driver 31 controls an actuator 45 which changes a position (height) of the receiving blade 16*b* of the cutting tool 16.

The electrical structure of the coiling machine 10 including CPU 20 functions as a controller 50 which controls the operation or the like of the coiling machine 10. The controller 50 includes a control circuit which controls the rotation operation of the material feeding roller 11 as a part of a material feeding mechanism. Furthermore, the controller 50 includes a control circuit which controls positions of the pins 13 and 14 through the pin driving mechanisms 41 and 42. Furthermore, the controller 50 includes a control circuit which controls the position of the pitch tool 15 through the pitch tool driving mechanism 43. Furthermore, the controller 50 includes a control circuit which controls the operation of the cutting tool 16 through the cutting tool driving mechanism 44.

To the controller 50 of the present embodiment, a personal computer 60 is connected through the communication interface 24. The personal computer 60 includes a display part 61 including a display panel, input operation part 62 including a key board, and pointing device 63 such as a mouse. The personal computer 60 includes a storage medium 64 which is detachably attached if necessary. The display operation part 35 of the controller 50 and the input operation part 62 of the personal computer 60 function as means to which shape data (control data) corresponding to the shape of the coil spring to be formed are input.

Figure 4:
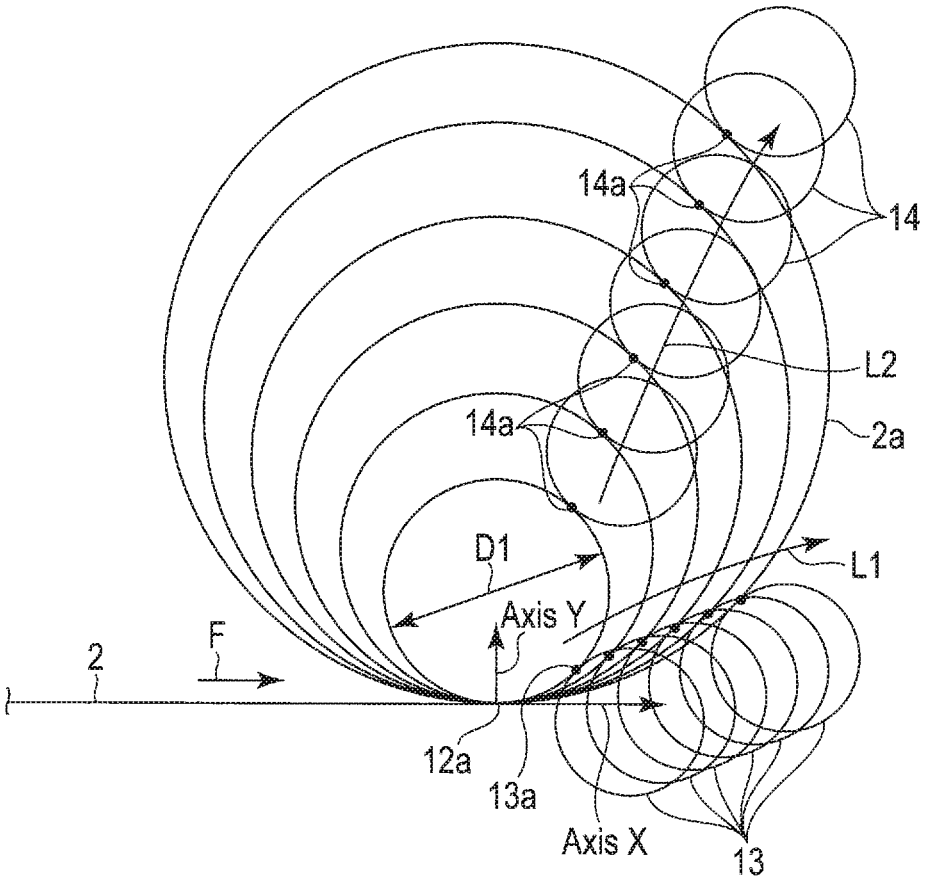
FIG. 4 is a schematic view showing loci of movement of a first pin and a second pin of the coiling machine of FIG. 1.

FIG. 4 schematically shows loci of movement of the first pin 13, and the second pin 14 which change positions corresponding to a coil diameter D1. With respect to the positions of the first pin 13 and the second pin 14, a direction F1 of the material 2 discharged from the tip 12*a* of the material guide 12 is given axis X, and a direction orthogonal to the axis X is given axis Y. The controller 50 controls the first pin driving mechanism 41 and the second pin driving mechanism 42 such that positions X and Y of the first pin 13 and the second pin 14 change corresponding to the input shape data of the coil spring (for example, coil diameter).

Specifically, the positions of the first pin 13 and the second pin 14 are controlled such that a first angle θ1 (shown in FIG. 1) becomes constant regardless of the coil diameter of the coil spring to be formed. Here, the first angle θ1 is an angle formed by a machine center M1 (shown in FIG. 1) and a line M2 connecting the contact point 14*a* of the second pin 14 and the center of curvature C2 of the material 2 which has passed the second pin 14. The machine center M1 is, for the convenience, set on an extension line of the blade surface of the cutting, tool 16 (cutter line). However, the machine center may be disposed in a different position by specifying original positions of the first pin 13 and the second pin 14.

As shown in FIG. 4, the controller 50 moves the first pin 13 and the second pin 14 corresponding to a coil diameter D1. Bending of the material starts at the tip 12*a* of the material guide 12. When the coil diameter D1 increases, the first pin 13 and the second pin 14 are moved such that a gap between the top 12*a* of the material guide 12 and the contact point 13*a* of the first pin 13 and a gap between the tip 12*a* of the material guide 12 and the contact point 14*a* of the second pin 14 increase. Furthermore, the positions of the first pin 13 and the second pin 14 are controlled such that a relationship between a position of turn at the contact point 14*a* of the second pin 14 with respect to the machine center M1 (corresponding to the first angle θ1 of FIG. 1) and a position of turn at the contact point 15*a* of the pitch tool 15 with respect to the machine center M1 (corresponding to a second angle θ2 of FIG. 1) becomes substantial constant.

A first line L1 of FIG. 4 is an example of a locus of movement of the first pin 13. The first line L1 draws the locus of an arc shape such that the position Y increases when the position X increases, and the increase ratio of the position Y slightly decreases with respect to the increase ratio of the position X. A second line L2 of FIG. 4 is an example of a locus of movement of the second pin 14. The second line L2 draws the locus of an arc shape such that the position Y greatly increases when the position X increases, and the increase ratio of the position Y slightly decreases with respect to the increase ratio of the position X.

CPU 20 of the controller 50 calculates the positions X and Y of the first pin 13 and the second pin 14 on the basis of the shape data of the coil spring to be formed. For example, when the coil diameter increases, the positions of the first pin 13 and the second pin 14 are controlled such that a gap between the tip 12*a* of the material guide 12 and the first pin 13 and a gap between the tip 12*a* of the material guide 12 and the second pin 14 increase. Furthermore, the positions of the first pin 13 and the second pin 14 are controlled such that the position of turn at the contact point 14*a* of the second pin 14 with respect to the machine center M1 becomes constant regardless of the coil diameter. At that time, the position of the second pin 14 is controlled such that the position of turn at the contact point 15*a* of the pitch tool 15 becomes substantially constant.

As shown in FIG. 1, the material 2 bent between the first pin 13 and the second pin 14 is released immediately after passing the second pin 14 and produces spring back. Thus, a radius of curvature R2 of the material 2 which has passed the second pin 14 becomes greater than a radius of curvature R1 of the arc part 2*a* between the first pin 13 and the second pin 14. Thus, CPU 20 controls the positions of the first pin 13 and the second pin 14 in consideration of the extent of spring back such that a center of curvature C2 after passing the second pin 14 is positioned on the machine center M1 of the coiling machine 10. Thus, a relationship between the first angle θ1 and the second angle θ2 is maintained substantially constant regardless of the coil diameter (the second angle θ2 may change slightly). The first angle θ1 is an angle formed by the second pin 14 with respect to the machine center M1. The second angle θ2 is an angle formed by the contact point 15*a* of the pitch tool 15 with respect to the machine center M1. Most suitable positions of the first pin 13 and the second pin 14 can be preliminarily derived by trials.

The controller 50 stores a plurality of control data corresponding to process temperatures. In the present embodiment, the number of control data corresponding to process temperatures is five; however, the number thereof may vary.

For example, first control data are used to control the positions of the first pin 13 and the second pin 14 in consideration of the extent of spring back when the temperature of the material 2 falls within a first temperature range (temperature range of cold working) wherein a gap between the center of curvature C1 of the arc part 2*a* and the cutting tool 16 is set to be minimized.

Second control data are used to control the positions of the first pin 13 and the second pin 14 in consideration of the extent of spring back when the temperature of the material 2 falls within a second temperature range which is higher than the first temperature range wherein a gap between the center of curvature C1 of the arc part 2*a* and the cutting tool 16 is set to be slightly greater than that of the cold working process.

Third control data are used to control the positions of the first pin 13 and the second pin 14 in consideration of the extent of spring back when the temperature of the material 2 falls within a third temperature range which is higher than the second temperature range wherein a gap between the center of curvature C1 of the arc part 2*a* and the cutting tool 16 is set to be greater than that of the process of the second temperature range.

Fourth control data are used to control the positions of the first pin 13 and the second pin 14 in consideration of the extent of spring back when the temperature of the material 2 falls within a fourth temperature range which is higher than the third temperature range wherein a gap between the center of curvature C1 of the arc part 2*a* and the cutting tool 16 is set to be greater than that of the process of the third temperature range.

Fifth control data are used to control the positions of the first pin 13 and the second pin 14 in consideration of the extent of spring back when the temperature of the material 2 falls within a fifth temperature range which is higher than the fourth temperature range wherein a gap between the center of curvature C1 of the arc part 2*a* and the cutting tool 16 is set to be maximized.

Figure 5:
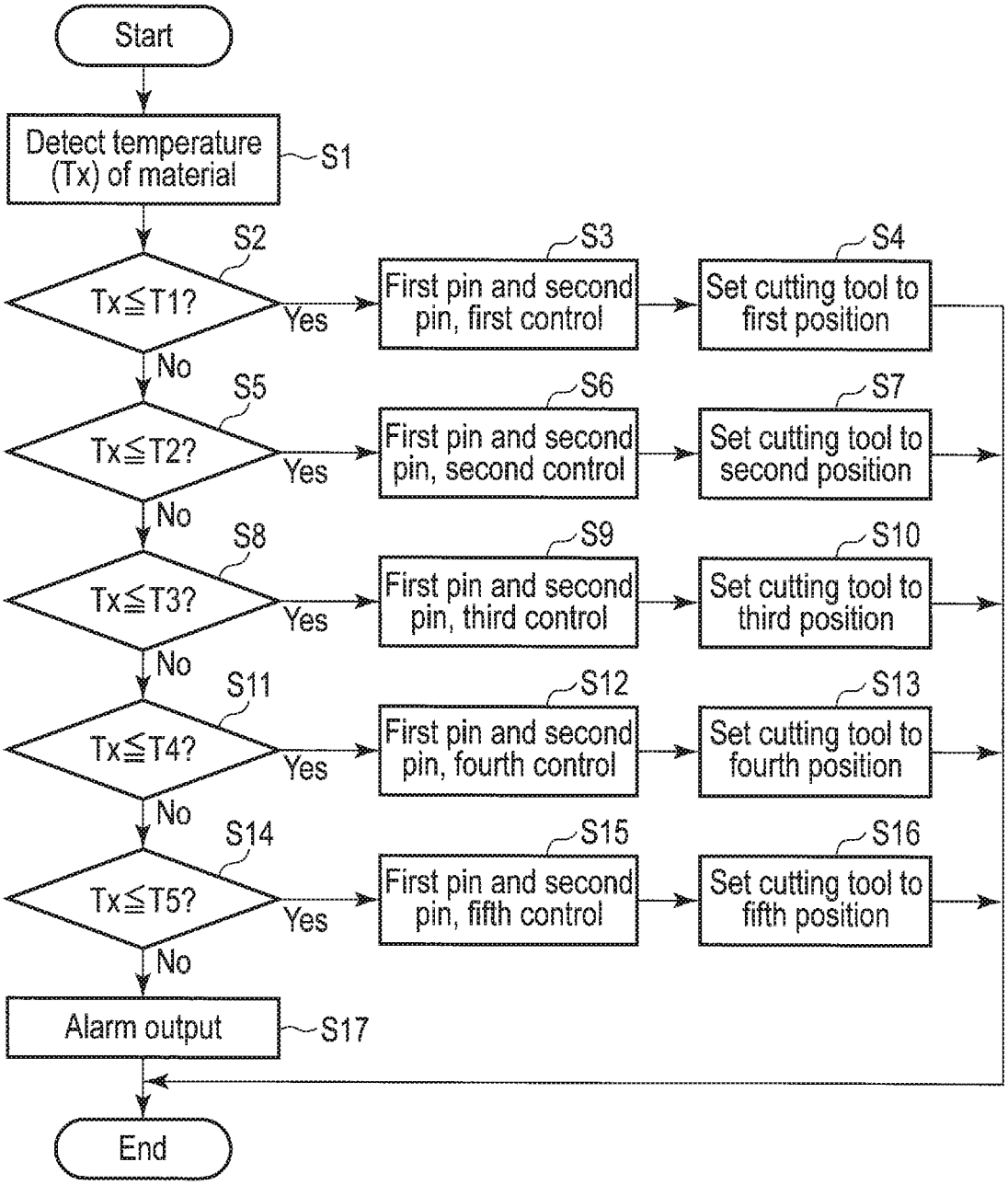
FIG. 5 is a flowchart of an example of a manufacturing process of a coil spring.

FIG. 5 is a flowchart showing a manufacturing method of the coil spring 1 using the coil machine 10 through cold working or warm working. Hereinafter, the manufacturing method of the coil spring will be explained with reference to the flowchart.

If the coil spring is manufactured through cold working, the heating device 17 is turned off, and the material 2 is not heated. On the other hand, if the coil spring is manufactured through warm working, the heating device 17 is turned on and the material 2 is heated.

In step S1 of FIG. 5, a temperature Tx of the material 2 is detected by the temperature sensor 18. In the cold working process, the temperature Tx of the material 2 is a temperature T1 (for example, 30° C.) or less, which causes Yes in step S2 and the process proceeds to step S3. In step S3, the first control data for the cold working process are called and the first pin 13 and the second pin 14 are moved to the positions suitable for the cold working process on the basis of the first control data. In step S4, the cutting tool 16 moves to a first position (first cutting position) and a gap between the center of curvature C1 of the arc part 2*a* and the cutting tool 16 is minimized.

FIG. 1 schematically shows the positions of the first pin 13, the second pin 14, and the cutting tool 16 in the cold working process. The material 2 moves to the first pin 13 from the tip 12*a* of the material guide 12 and is formed in an arc shape by the first pin 13 and the second pin 14. Thus, the arc part 2*a* with the radius of curvature R1 is formed between the first pin 13 and the second pin 14. The radius of curvature R2 of the material 2 which has passed the second pin 14 and produced spring back becomes greater than the radius of curvature R1 of the arc part 2*a*. The upper surface of the receiving blade 16*b* of the cutting tool 16 is positioned approximately above the locus of movement of the material 2 which has passed the second pin 14. In this state, the material 2 continuously moves from the tip 12*a* of the material guide 12. When one unit of the coil spring 1 is formed, the movement of the material 2 stops for a while and the movable blade 16*a* of the cutting tool 16 works, and the rear end of the coil spring 1 (the front end of a next coil spring) is cut.

If the coil spring 1 is manufactured through the warm working process, the material 2 is heated by the heating device 17. If the temperature Tx of the material detected by the temperature sensor 18 exceeds the first temperature T1, No is determined in step S2 of FIG. 5 and the process proceeds to step S5. In step S5, the temperature Tx of the material is compared to a second temperature T2 (for example, 100° C.), and if the temperature Tx of the material is equal to or less than the second temperature T2, the process proceeds to step S6. In step S6, the second control data are called, and the first pin 13 and the second pin 14 move to the positions suitably for the second temperature range. Furthermore, in step S7, the cutting tool 16 moves to the second position.

In step S5, if the temperature Tx of the material exceeds the second temperature T2, the process proceeds to step S8. In step S8, the temperature Tx of the material is compared to a third temperature T3 (for example, 200° C.), and if the temperature Tx of the material is equal to or less than the third temperature T3, the process proceeds to step S9. In step S9, the third control data are called, and the first pin 13 and the second pin 14 are moved to the positions suitable for the third temperature range. Furthermore, in step S10, the cutting tool 16 moves to the third position.

In step S8, if the temperature Tx of the material exceeds the third temperature T3, the process proceeds to step S11. In step S11, the temperature Tx of the material is compared to a fourth temperature T4 (for example, 300° C.), and if the temperature Tx of the material is equal to or less than the fourth temperature T4, the process proceeds to step S12. In step S12, the fourth control data are called, and the first pin 13 and the second pin 14 are moved to the positions suitable for the fourth temperature range. Furthermore, in step S13, the cutting tool 16 moves to the fourth position.

In step S11, if the temperature Tx of the material exceeds the fourth temperature T4, the process proceeds to step S14. In step S14, the temperature Tx of the material is compared to a fifth temperature T5 (for example, 400° C.), and if the temperature Tx of the material is equal to or less than the fifth temperature T5, the process proceeds to step S15. In step S15, the fifth control data are called, and the first pin 13 and the second pin 14 are moved to the positions suitable for the fifth temperature range. Furthermore, in step S16, the cutting tool 16 moves to the fifth position.

In step S14, if the temperature Tx of the material exceeds the fifth temperature T5, the temperature is determined to be overheated for a warm working process, and the process proceeds to step S17. In step S17, a display indicative of an error or an alarm is output to, for example, the display part 61 (shown in FIG. 3) to inform an operator.

FIG. 2 schematically shows the positions of the first pin 13, the second pin 14, and the cutting tool 16 in the warm working process. As in the cold working process, the material 2 continuously moves from the tip 12*a* of the material guide 12 and is formed in an arc shape by the first pin 13 and the second pin 14. Thus, the arc part 2*a* with a radius of curvature R1' is formed between the first pin 13 and the second pin 14.

Spring back produced in the warm working process less than that of the cold working process. Thus, if the radius of curvature R1' of the arc part 2*a* produced through the warm working process is set to the same as a radius of curvature R1 of the arc part 2*a* produced through the cold working process, the radius of curvature R2' of the material 2 after passing the second pin 14 in the warm working process (shown in FIG. 2) becomes less than the radius of curvature R2 of the material 2 after passing the second pin 14 in the cold working process (shown in FIG. 1). Furthermore, the cutting tool 16 in the warm working process is shifted from a locus of movement of the material 2.

In contrast, the coiling machine 10 of the present embodiment manufactures the coil spring through the warm working process by suing control data corresponding to the temperature of the material 2 such that the radius of curvature R1' of the arc part 2*a* becomes greater than the radius of curvature R1 of the arc part 2*a* in the cold working process as compared to a case where the coil spring of the same diameter is manufactured through the cold working process. On the basis of the selected control data, the first pin 13, second pin 14, and cutting tool 16 are moved to the positions suitable for the process temperature. Thus, the radius of curvature R2' of the coil spring manufactured through the warm working process after spring back can be substantially equal to the radius of curvature R2 of the coil spring manufactured through the cold working process after spring back. Furthermore, the receiving blade 16*b* of the cutting tool 16 in the warm working process can be moved to the position above the locus of movement of the material 2.

According to the coiling machine 10 of the present embodiment, a coil spring manufactured through a warm working process is formed in an accurate shape by first pin 13 and second pin 14 as in the case of cold working process, and the coil spring can be cut at a proper cutting position.

The coiling machine 10 of the present embodiment can manufacture coil springs of constant shape even if the temperature of the material heated by a heating device 17 in the warm working process changes for any reason. The coiling machine 10 can be used in both the cold working process and the warm working process.

As described above, a manufacturing method of the coil spring of the present embodiment includes the following steps when the coil spring 1 is formed through the warm working process.

(1) Heating a material 2 of a coil spring 1;

(2) Detecting a temperature of the heated material 2;

(3) Moving a first pin 13 and a second pin 14 such that, when the detected temperature of the material 2 becomes higher, a radius of curvature R1' of an arc part 2*a* formed between the first pin 13 and the second pin 14 becomes greater than a radius of curvature 1 of the arc part 2*a* of the coil spring in a cold working process;

(4) Moving the cutting tool 16 such that, when the temperature of the material 2 becomes higher, a gap between a center of curvature C1 of the arc part 2*a* and a cutting tool 16 becomes greater than a gap between a center of curvature C1 of the arc part 2*a* and the cutting tool 16 in the cold working process;

(5) Forming the coil spring 1 by continuously moving the heated material 2 from a tip 12*a* of a material guide 12 to the first pin 13 and bending the material 2 between the first pin 13 and the second pin 14; and (6) Cutting one unit of the formed coil spring 1 by the cutting tool 16.

Note that, in the present embodiment, the number of control data corresponding to the process temperatures is five; however, the number may vary. Or, control data continuously change corresponding to process temperatures continuously change may be used. Furthermore, in order to achieve the present invention, as a matter of course, various changes may be applied, if necessary, to the structures and arrangements of each of the components of the coiling machine including the material guide, first pin, second pin, pitch tool, cutting tool, heating device, temperature sensor, etc.

The coiling machine of the present invention can be applied to manufacturing of coil springs of various types such as a cylinder coil spring, barrel coil spring, a hourglass-shaped coil spring, tapered coil spring, uneven pitch coil spring, or partly minus pitched coil spring.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coiling machine comprising:

a material guide to which a material of a coil spring is inserted, the material guide having a tip from which the material is discharged;

a first pin which contacts the material discharged from the tip of the material guide;

a second pin disposed in a front side of a movement direction of the material with respect to the first pin, the second pin and the first pin bending the material into an arc shape;

a pitch tool disposed in a front side of a movement direction of the material with respect to the second pin, the pitch tool contacting the material;

a cutting tool which cuts the material, the cutting tool including a movable blade and a receiving blade;

an actuator which changes a position of the receiving blade of the cutting tool;

a heating device which heats the material;

a temperature sensor which detects a temperature of the material; and a controller which changes a position of the first pin and a position of the second pin based on control data corresponding to a shape of a coil spring to be formed, wherein the first pin and the second pin are moved such that a radius of curvature of the arc shape increases when the temperature of the material detected by the temperature sensor increases, and the receiving blade of the cutting tool is moved by the actuator such that a gap between a center of curvature of the arc shape and the receiving blade of the cutting tool increases when the temperature of the material increases.

* * * * *